US007826778B2

(12) United States Patent
Sano et al.

(10) Patent No.: US 7,826,778 B2
(45) Date of Patent: Nov. 2, 2010

(54) POWDER SUPPLYING DEVICE AND IMAGE FORMING DEVICE

(75) Inventors: Hiroshi Sano, Shizuoka (JP); Hirosato Amano, Shizuoka (JP); Keizo Chiba, Shizuoka (JP); Hiroshi Tateishi, Shizuoka (JP); Tetsuo Noji, Shizuoka (JP); Kazuhisa Sudo, Kanagawa (JP); Fumihito Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 421 days.

(21) Appl. No.: 11/911,598

(22) PCT Filed: Jan. 29, 2007

(86) PCT No.: PCT/JP2007/051841

§ 371 (c)(1),
(2), (4) Date: Oct. 15, 2007

(87) PCT Pub. No.: WO2007/094182

PCT Pub. Date: Aug. 23, 2007

(65) Prior Publication Data

US 2008/0193161 A1 Aug. 14, 2008

(30) Foreign Application Priority Data

Feb. 14, 2006 (JP) ..... 2006-035919
Apr. 20, 2006 (JP) ..... 2006-117172

(51) Int. Cl.
*G03G 15/08* (2006.01)

(52) U.S. Cl. ..... 399/258; 399/120

(58) Field of Classification Search ..... 399/107, 399/119, 120, 252, 258–262
See application file for complete search history.

(56) References Cited

U.S. PATENT DOCUMENTS 5,950,055 A 9/1999 Yahata et al.
5,950,062 A 9/1999 Yahata et al.

(Continued)

FOREIGN PATENT DOCUMENTS

JP 58 35564 3/1983

(Continued)

OTHER PUBLICATIONS

U.S. Appl. No. 12/018,611, filed Jan. 23, 2008, Sano.

(Continued)

*Primary Examiner*—Hoan Tran
(74) *Attorney, Agent, or Firm*—Oblon, Spivak, McClelland, Maier & Neustadt, L.L.P.

(57) ABSTRACT

In a powder supplying device, a powder container contains powder therein and is provided at a bottom of the powder container with a gas blowout part for ejecting gas to the inside of the powder container. A powder transport unit attracts powder contained in the powder container from a suction opening and transports the powder to a powder receiving device. A first detection unit is provided in the powder container to detect a remaining powder in the powder container.

20 Claims, 10 Drawing Sheets

U.S. PATENT DOCUMENTS

| | | | | |
|---|---|---|---|---|
| 6,091,912 | A | 7/2000 | Kitajima et al. | |
| 6,201,941 | B1 * | 3/2001 | Kasahara et al. | 399/258 |
| 6,393,241 | B1 | 5/2002 | Matsumoto et al. | |
| 6,501,913 | B2 | 12/2002 | Hattori et al. | |
| 6,577,842 | B2 | 6/2003 | Akiba et al. | |
| 6,591,077 | B2 | 7/2003 | Yanagisawa et al. | |
| 6,628,908 | B2 | 9/2003 | Matsumoto et al. | |
| 6,648,029 | B1 | 11/2003 | Amano | |
| 6,665,508 | B2 | 12/2003 | Sudo et al. | |
| 6,679,301 | B2 | 1/2004 | Makino et al. | |
| 6,775,503 | B2 | 8/2004 | Hattori et al. | |
| 6,826,381 | B2 | 11/2004 | Muramatsu et al. | |
| 6,859,634 | B2 | 2/2005 | Itoh et al. | |
| 6,863,096 | B2 | 3/2005 | Amano | |
| 6,874,546 | B2 | 4/2005 | Amano et al. | |
| 6,917,779 | B2 * | 7/2005 | Fujimori et al. | 399/258 |
| 6,981,530 | B2 | 1/2006 | Amano et al. | |
| 7,017,625 | B2 | 3/2006 | Amano et al. | |
| 7,283,772 | B2 * | 10/2007 | Amano et al. | 399/258 |
| 2002/0020461 | A1 | 2/2002 | Platsch | |
| 2005/0244193 | A1 | 11/2005 | Amano et al. | |
| 2006/0024101 | A1 | 2/2006 | Schoch et al. | |
| 2006/0213573 | A1 | 9/2006 | Amano | |
| 2007/0157990 | A1 | 7/2007 | Amano | |
| 2007/0201904 | A1 | 8/2007 | Sano et al. | |
| 2007/0201905 | A1 | 8/2007 | Sano et al. | |
| 2007/0212116 | A1 | 9/2007 | Itoh et al. | |
| 2007/0212117 | A1 | 9/2007 | Itoh et al. | |

FOREIGN PATENT DOCUMENTS

| | | |
|---|---|---|
| JP | 1 179062 | 7/1989 |
| JP | 04 034480 | 2/1992 |
| JP | 7 56431 | 3/1995 |
| JP | 2000 019830 | 1/2000 |
| JP | 2000 147879 | 5/2000 |
| JP | 2001 175070 | 6/2001 |
| JP | 2001 183906 | 7/2001 |
| JP | 2002 328520 | 11/2002 |
| JP | 3534159 | 3/2004 |
| JP | 3549051 | 4/2004 |
| JP | 2005 024622 | 1/2005 |
| JP | 2005 215655 | 8/2005 |
| JP | 2005 292300 | 10/2005 |
| JP | 2006 047972 | 2/2006 |
| JP | 2006 048009 | 2/2006 |
| JP | 2006 048010 | 2/2006 |

OTHER PUBLICATIONS

U.S. Appl. No. 11/736,296, filed Apr. 17, 2007, Sano.

* cited by examiner

POWDER SUPPLYING DEVICE AND IMAGE FORMING DEVICE

TECHNICAL FIELD

This invention relates to a powder supplying device which supplies powder, such as toner, to a powder receiving device, and to an image forming device in which the powder supplying device is provided, the image forming device using the electrophotographic printing method like a copier, a printer, a facsimile, or a multi-function peripheral.

BACKGROUND ART

Conventionally, powder supplying devices for accommodating a mass toner, such as toner banks and toner replenishing devices, are known for use in image forming devices, such as copiers or printers. For example, see Japanese Patent No. 3534159 and Japanese Laid-Open Patent Application No. 2005-024622.

Japanese Patent No. 3534159 discloses a powder supplying device (toner bank) in which a plurality of toner containers in the shape of toner bottles are installed. Specifically, one of the plurality of toner containers is opened, and the toner contained in the toner container is supplied to a toner hopper of the toner bank. The toner in the toner hopper is transported by a gas-flow transporting unit to a developing device which is a powder receiving device. And when the toner in the opened toner container becomes empty, another toner container among the plurality of toner containers is opened and toner replenishment is performed with the newly opened toner container.

Japanese Laid-Open Patent Application No. 2005-024622 discloses a toner replenishing device in which a toner hopper having a capacity larger than the capacity of a toner container is provided. Specifically, the toner hopper is capable of containing an amount of toner equivalent to the amount of toner contained in the plurality of toner containers. A stirring member is installed in the toner hopper and the toner inside the toner hopper is agitated by the stirring member. And the toner in the toner hopper is discharged from the lower part of the toner hopper, and is transported by a fluid transporting unit to a developing device which is a powder receiving device.

Moreover, Japanese Patent No. 3549051 discloses a powder supplying device (powder filling apparatus) which is adapted for filling up a toner container (powder container) with toner (powder). Specifically, air is introduced into the powder filling apparatus, and the air pressure in the powder filling apparatus is increased, so that the toner (powder) contained in the powder filling apparatus is discharged from a powder transport tube, and it is transported to a toner container which is a powder receiving device.

Since a plurality of toner containers are installed in the powder supplying device of Japanese Patent No. 3534159, transporting of a large amount of toner is attained. However, after all the toner contained in the plurality of toner containers becomes empty, the setting work of a number of new toner containers corresponding to the number of the used toner containers will arise. Therefore, there is the problem that the workability at the time of toner end does not improve even if transporting of a large amount of toner is attained.

The powder supplying device of Japanese Laid-Open Patent Application No. 2005-024622 uses a large-capacity toner hopper which is aimed at transporting of a large amount of toner. However, since the toner in the toner hopper is mechanically agitated by the stirring member in order to prevent bridge formation of the toner contained in the hopper, mechanical stress may arise in the toner. If mechanical stress arises in the toner, the additive agent included in the toner may be deviated in the toner surface or separated from the toner surface. Even if the toner is a new toner, the toner is in a deteriorated condition, which will cause the quality of image to be lowered.

Moreover, the powder supplying device of Japanese Laid-Open Patent Application No. 2005-024622 is provided so that toner is discharged from the lower part of the toner hopper. When the sealing performance near the exhaust opening falls, the amount of toner which scatters from the powder supplying device will be increased.

The powder supplying device of Japanese Patent No. 3549051 is provided such that high pressure is applied to the container containing toner, so that the toner is discharged from the inside of the container. For this reason, it is necessary that the mechanical strength of the container is set to a sufficiently high level, so that the container may not be broken by the applied pressure.

Therefore, even if the powder supplying device of Japanese Patent No. 3549051 can be used as a manufacturing device which fills up a toner container with toner, it is difficult to use the same for supplying toner to a developing device in an image forming device. Moreover, if the method of discharging the toner from the inside of the container by applying high pressure to the container which contains toner is used, the amount of toner discharged changes sharply according to the amount of toner remaining in the container. And it is difficult to adjust finely the amount of toner discharged. Therefore, even if the powder supplying device of Japanese Patent No. 3549051 can be used as a manufacturing device which fills up a toner container with toner, it is difficult to use the same for supplying toner to a developing device in an image forming device.

The above-mentioned problems are common in all the powder supplying devices, including a powder supplying device provided in an image forming device to supply toner, which require the fine adjustment of the amount of powder supplied, without damaging the powder. And it is necessary for all those powder supplying devices to supplement powder into the powder container in appropriate timing, in order to reduce the inoperative time of the powder receiving device (or a developing device in an image forming device) when the powder contained in the powder container becomes empty.

DISCLOSURE OF THE INVENTION

According to one aspect of the invention, there is provided an improved powder supplying device in which the above-mentioned problems are eliminated.

According to one aspect of the invention, there is provided a powder supplying device which is adapted for performing fine adjustment of the amount of powder supplied, without damaging the powder, and does not cause the scattering of the powder nor the inoperative condition of the powder receiving device.

In an embodiment of the invention which solves or reduces one or more of the above-mentioned problems, there is provided a powder supplying device which supplies powder to a powder receiving device, the powder supplying device comprising: a powder container containing powder thereon and provided at a bottom of the powder container with a first gas blowout part for ejecting gas to the inside of the powder container; a powder transport unit attracting powder contained in the powder container from a suction opening and transporting the powder to the powder receiving device; and a first detection unit provided in the powder container to detect a remaining powder in the powder container.

In an embodiment of the invention which solves or reduces one or more of the above-mentioned problems, there is provided an image forming device in which a powder supplying device is provided to supply powder to a powder receiving device, the powder supplying device comprising: a powder container containing powder therein and provided at a bottom of the powder container with a gas blowout part for ejecting gas to the inside of the powder container; a powder transport unit attracting powder contained in the powder container from a suction opening and transporting the powder to the powder receiving device; and a first detection unit provided in the powder container to detect a remaining powder in the powder container.

According to the embodiments of the invention, the powder is attracted from the suction opening by the powder transport unit, while gas is ejected from the gas blowout part at the bottom of the powder container. The first detection unit is provided to detect a remaining powder in the powder container. It is possible to provide the powder supplying device and the image forming device which are adapted for performing fine adjustment of the amount of powder supplied, without damaging the powder, and do not cause the scattering of the powder nor the inoperative condition of the powder receiving device.

BRIEF DESCRIPTION OF THE DRAWINGS

Other objects, features and advantages of the present invention will be apparent from the following detailed description when reading in conjunction with the accompanying drawings.

BEST MODE FOR CARRYING OUT THE INVENTION

A description will now be given of an embodiment of the invention with reference to the accompanying drawings.

An image forming device and a powder supplying device in an embodiment of the invention will be explained with reference to FIG. 1-FIG. 8.

Figure 1:
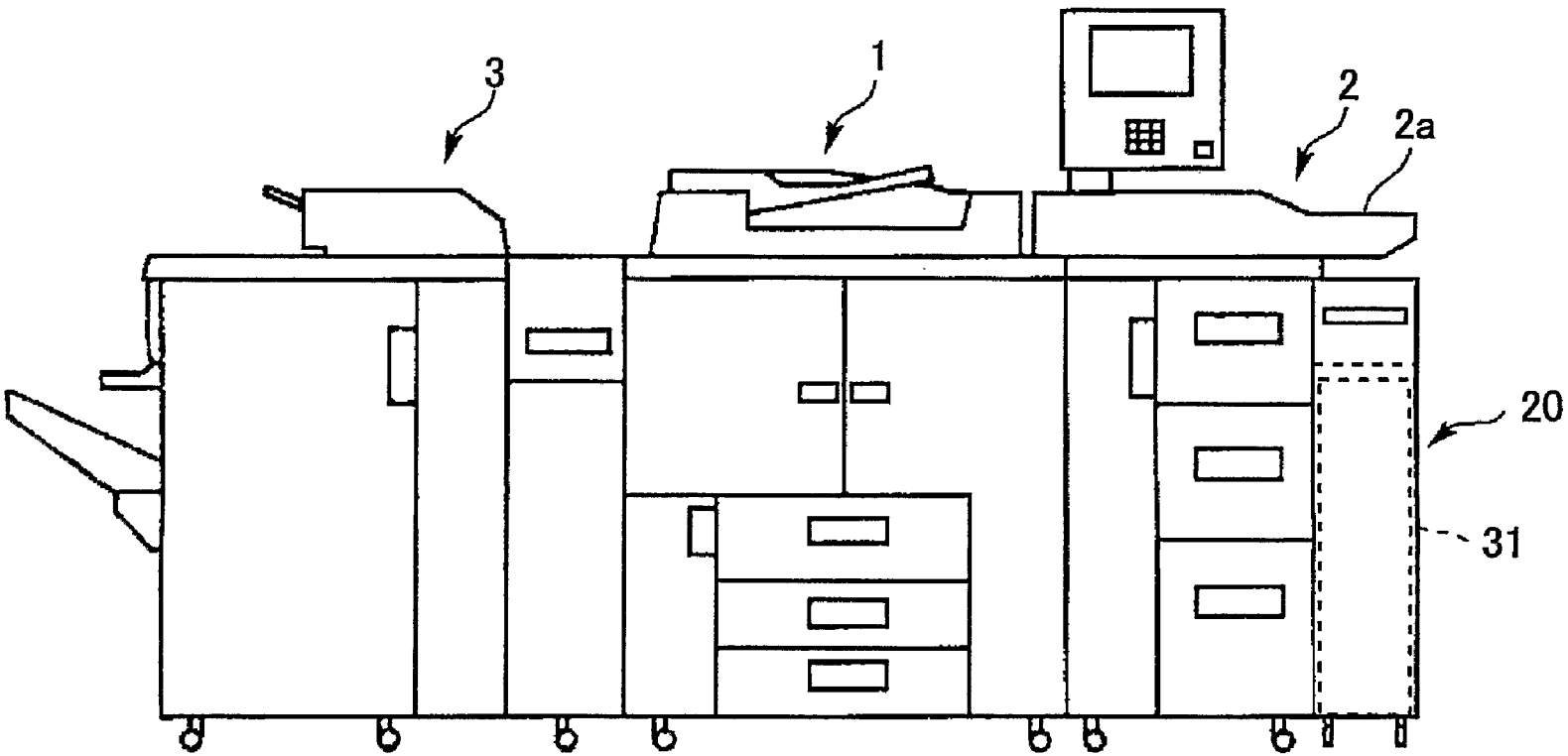
FIG. 1 is a diagram showing the outline composition of an image forming device in an embodiment of the invention.
Figure 2:
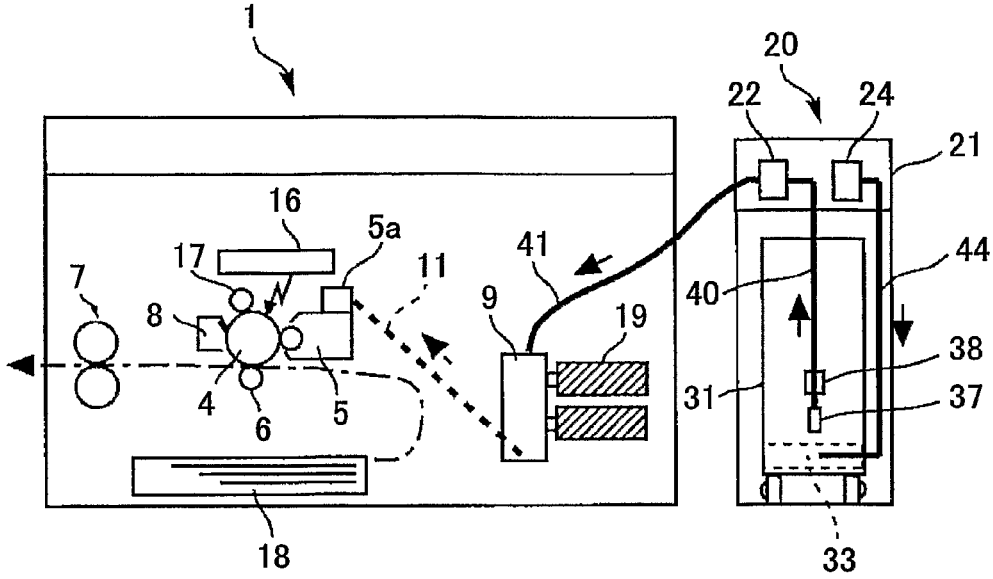
FIG. 2 is a diagram showing an image forming device body and a powder supplying device.

First, as shown in FIG. 1 and FIG. 2, the structure and operation of the image forming device in this embodiment will be explained. FIG. 1 shows the outline composition of the image forming device in this embodiment. FIG. 2 shows an image forming device body and a powder supplying device in this embodiment.

In FIG. 1, reference numeral 1 denotes an image forming device body (copying module) which forms a main part of an electrophotographic image forming device, reference numeral 2 denotes a mass feeding bank (sheet feeding unit), reference numeral 3 denotes a post-processing unit which performs sorting, stapler fixing, etc., and reference numeral 20 denotes a powder supplying device (toner supplying unit). The powder supplying device 20 is installed under the wing 2*a* of the paper feed tray disposed above the mass feeding bank 2.

In FIG. 2, reference numeral 1 denotes an image forming device body, reference numeral 4 denotes a photoconductive drum which is an image support, reference numeral 5 denotes a developing unit 5 (developing device) which develops the electrostatic latent image which is formed on the photoconductive drum 4, reference numeral 6 denotes a transfer unit which transfers the toner image formed on the photoconductive drum 4 to a recording medium, such as a copy sheet, reference numeral 7 denotes a fixing unit which fixes the non-fixed toner to the recording medium, reference numeral 8 denotes a cleaning unit which collects the non-transferred toner on the photoconductive drum 4, reference numeral 16 denotes an exposure unit which irradiates the exposing light to the photoconductive drum 4 in accordance with the image information which is read by the document reading part, reference numeral 17 denotes a charging unit which charges the surface of the photoconductive drum 4, and reference numeral 18 denotes a sheet feeding unit in which a number of recording media, such as copy sheets, are contained.

Moreover, in FIG. 2, reference numeral 9 denotes a toner hopper which is a powder receiving device (toner receiving device) to which the toner is supplied from the powder supplying device 20, reference numeral 11 denotes a toner transporting line through which the toner in the toner hopper 9 is transported to the toner replenishing part 5*a* of the developing unit 5, and reference numeral 19 denotes a toner container (toner bottle) which is a second toner container provided to supply the toner to the toner hopper 9 separately from the powder supplying device 20.

With reference to FIG. 2, operation of the image forming device when usual image formation is performed will be explained.

By the transporting roller of the document transporting part, a document is transported from the document glass and passes through the top of the document reading part. At this time, image information is optically read from the document, which passes through the top of the document reading part, by the document reading part. And the image information optically read by the document reading part is converted into an electrical signal, and then the electrical signal is transmitted to the exposure unit 16. The exposure unit 16 emits the exposing light, such as a laser beam, to the surface of the photoconductive drum 4 in accordance with the image information of the electrical signal received.

On the other hand, the photoconductive drum 4 is rotated in the clockwise rotation direction in FIG. 2. The surface of the photoconductive drum 4 is charged uniformly in the position opposed to the charging unit 17. And the surface of the photoconductive drum 4 charged by the charging unit 17 arrives at the irradiation position of the exposing light. And an electrostatic latent image corresponding to the image information of the document is formed in this location on the photoconductive drum 4.

Thereafter, the surface of the photoconductive drum 4 on which the electrostatic latent image is formed reaches the position opposite to the developing unit 5. And the latent image on the photoconductive drum 4 is developed by the developing unit 5. The toner in the developing unit 80 is mixed with a carrier by a paddle roller, together with the toner supplied from the toner replenishing part 5*a*. And the toner which is frictionally charged is supplied together with the carrier to the developing roller which counters the photoconductive drum 4.

The toner of the toner replenishing part 5*a* is suitably supplied to the developing unit 5 according to consumption of the toner in the developing unit 5. Therefore, consumption of the toner in the developing unit 5 is detected by the photosensor which counters the photoconductive drum 4, and by the permeability sensor provided in the developing unit 5.

The toner in the toner replenishing part 5*a* is suitably supplied from the toner hopper 9 via the toner transporting line 11 in which a toner transporting coil and a powder pump are provided. The toner in the toner hopper 9 is transported by the powder transport units 37, 40, 22, and 41 in the powder supplying device 20 which is externally installed in the image forming device 1. The toner hopper 9 in this embodiment is provided so that a plurality of toner containers 19 can be installed in the toner hopper 9, and the toner can be supplied to the toner hopper 9 from the toner container 19.

Then, the surface of the photoconductive drum 4 which is developed by the developing unit 5 reaches the location which is opposed to the transfer unit 6. And the toner image on the photoconductive drum 4 is transferred to the recording medium in this location. At this time, the non-transferred toner which is not transferred to the recording medium remains slightly on the photoconductive drum 4.

Then, the surface of the photoconductive drum 4 surface with the non-transferred toner which passes through the transfer unit 6 reaches the location which is opposed to the cleaning unit 8. And the non-transferred toner is collected by the cleaning unit 8 with the cleaning blade which contacts the photoconductive drum 4.

Then, the surface of the photoconductive drum 4 which passes through the cleaning unit 8 reaches an electric discharging unit (not shown in FIG. 2). And the electric potential of the surface of the photoconductive drum 4 is discharged by the discharging unit. Then, a series of imaging processes is completed.

On the other hand, the recording medium transported by the transfer unit 6 operates as follows. First, one sheet feeding unit is chosen from among the plurality of sheet feeding units by automatic or manual control. Suppose that the sheet feeding unit 18 is chosen.

And one sheet of the recording medium contained in the sheet feeding unit 18 is transported along the transporting line indicated by the one-dot chain line in FIG. 2.

Then, the recording medium which is transported from the sheet feeding unit 18 arrives at the location of a resist roller. And the timing of transport of the recording medium arrived at the location of the resist roller is adjusted in order to match with the timing of movement of the toner image formed on the photoconductive drum 4, and the recording medium is transported to the transfer unit 6.

After the transfer process is performed the recording medium reaches the fixing unit 7 through the transporting line after passing through the location of the transfer unit 6. And the non-fixed toner image is fixed to the recording medium by heat and pressure in the location of the fixing unit 7. Then, the recording medium after the fixing process is performed is ejected from the image forming device as an output image, and the recording medium is transported to the post-processing unit 3 so that the post-processing is performed by the post-processing unit 3. In this way, a series of image formation processes are performed.

Figure 3:
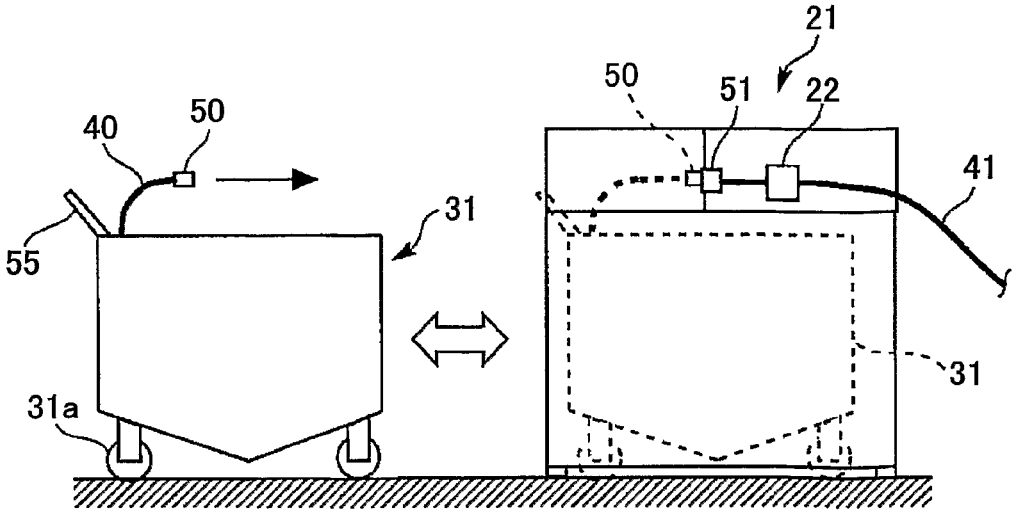
FIG. 3 is a diagram showing the condition that a powder container is detached from a powder supplying device.
Figure 4:
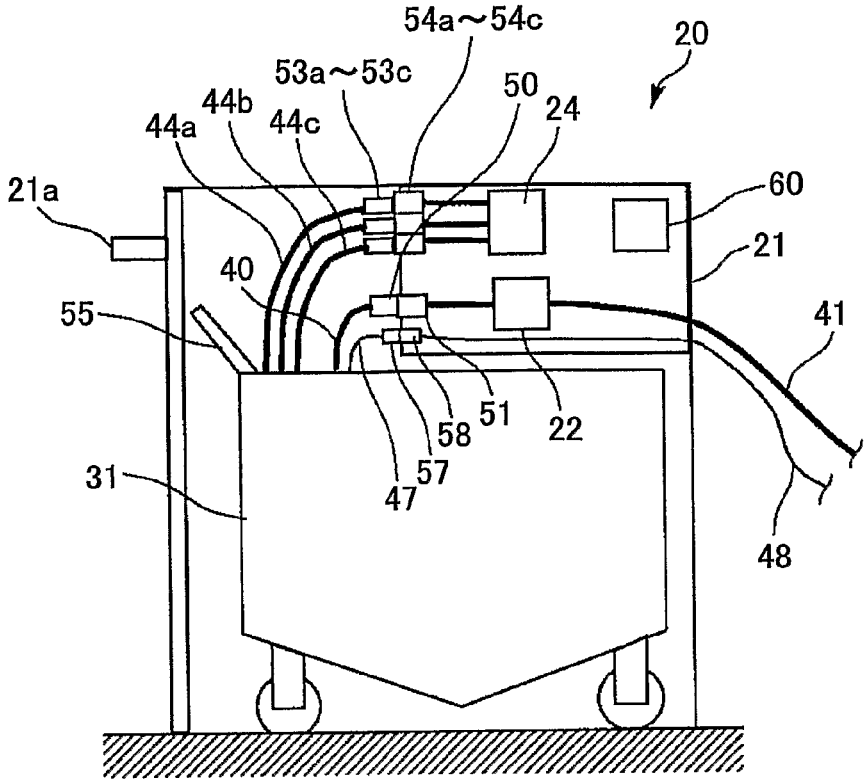
FIG. 4 is a block diagram showing the composition of a powder supplying device in an embodiment of the invention.
Figure 5:
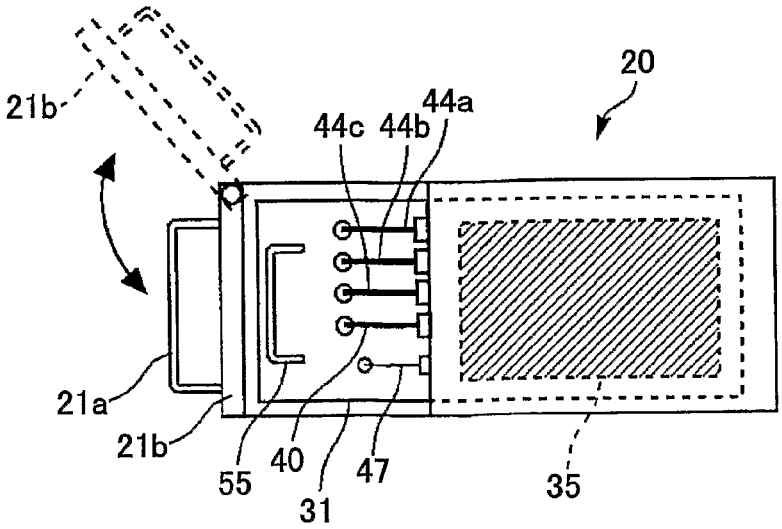
FIG. 5 is a top view of the powder supplying device shown in FIG. 4.
Figure 6:
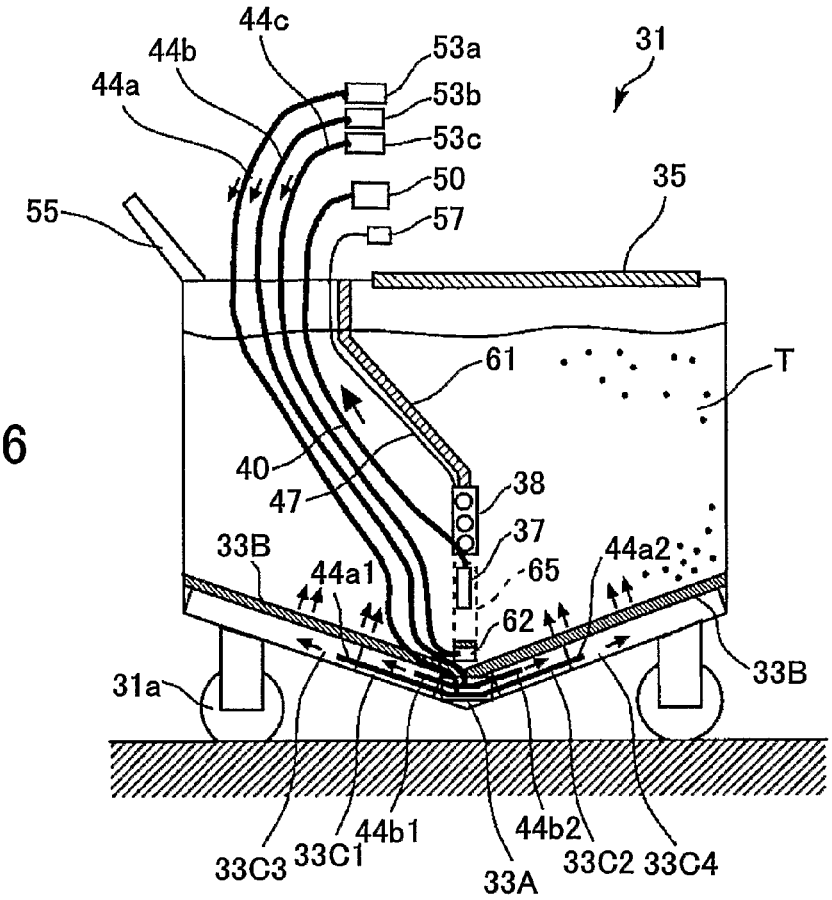
FIG. 6 is a block diagram showing the powder container of the powder supplying device.

Next, the structure and operation of the powder supplying device 20 will be explained. FIG. 3 is a diagram showing the condition that a powder container is detached from a powder supplying device. FIG. 4 is a block diagram showing the composition of a powder supplying device in an embodiment of the invention. FIG. 5 is a top view of the powder supplying device shown in FIG. 4. FIG. 6 is a block diagram showing the powder container of the powder supplying device.

As shown in FIG. 2-FIG. 5, the powder supplying device 20 (toner supplying unit) includes a powder supplying device body 21 (fixed unit) fixed to the image forming device (mass sheet feeding bank 2), and a powder container 31 (toner tank unit) which contains toner (powder) therein.

As shown in FIG. 3, the powder container 31 is detachably attached to the powder supplying device body 21. Specifically, a set of rollers 31*a* are provided on the bottom of the powder container 31, and a gripping part 55 is provided on the top of the powder container 31. And an operator, such as a user or a serviceman, will move the powder container 31 on a floor using the rollers 31*a* (in the direction indicated by the white arrow in FIG. 3), while holding the gripping part 55. In the powder supplying device body 21, a door 21*b* having a handle 21*a* is provided (see FIG. 5). The door 21*b* is opened or closed by the operator, so that attachment or detachment of the powder container 31 to the powder supplying device body 21 is performed. At this time, the connection or disconnection of connection terminals 50, 53*a*-53*c* and 57 on the side of powder container 31, and connection terminals 51, 54*a*-54*c* and 58 on the side of powder supplying device body 21 is performed (see FIG. 4).

The powder supplying device 20 in this embodiment is provided so that the powder container 31 containing toner can be detached from the powder supplying device body 21 and can be moved to another location. When the toner in the powder container 31 becomes empty mostly, the used powder container 31 can be replaced with a new powder container 31 which is filled with toner. If the changing work is performed, toner from the new powder container 31 can be continuously supplied to the image forming device 1. Since the powder supplying device 20 has a power supplying part 60 which is formed separately from the power source of the image forming device 1, the powder container 31 can be exchanged without turning off the image forming device 1. Thus, the powder container 31 can be exchanged without causing the inoperative time of the image forming device 1.

As shown in FIG. 4, the elements provided in the powder supplying device body 21 include the pump 22 (diaphragm type air pump) which attracts the toner T contained in the powder container 31 and transports the toner to the powder receiving device (toner hopper 9), the air pump 24 which supplies air to the gas blowout part 33, and the power supplying part 60.

In this embodiment, the powder receiving device to which the toner from the powder supplying device 20 is supplied is the toner hopper 9 of the image forming device 1. Alternatively, the powder receiving device may be made into the toner replenishing part 5*a* of the developing unit 5 in the image forming device 1.

As shown in FIG. 6, the elements provided in the powder container 31 include the suction tube 37, the gas blowout parts 33A, 33B, 33C1 to 33C4, the four flexible tubes 40, 44*a*-44*c* (made of silicone rubber), the second gas blowout part 62, the holding member 65 (which holds the second gas blowout part 62 and the suction tube 37), the remaining toner sensor 38 (near end sensor) (which is a first detection unit detecting a remaining toner in the powder container 31), the cable 47 (harness line) (which is electrically connected to the remaining toner sensor 38), and the column 61 (which supports the remaining toner sensor 38, the holding member 65 and the cable 47). In the powder container 31, the toner T which is powder is contained, and the volume average particle diameter of the toner T is in a range of 3-15 micrometers.

The bottom of the powder container 31 is formed into a sloping surface which is inclined so that a lowest location of the sloping surface is around a center of the sloping surface. In other words, the vertical cross-section of the bottom of the powder container 31 is formed in the shape of a V character. And gas blowout parts 33A, 33B and 33C1 to 33C4 are disposed on the bottom of powder container 31 which is formed into the sloping surface.

The sloping surface of the bottom of the powder container 31 is set to have an angle of gradient smaller than a limit angle (which is an angle of gradient when the toner starts slipping down) with respect to the toner T contained in the powder container 31. Specifically, the angle of gradient of the sloping surface is set to be about 20 degrees whereas the limit angle of the toner T is about 40 degrees. Since the angle of gradient of the sloping surface is set to be sufficiently small, it is possible to make the dead space due to the slope small, prevent the toner from depositing only at the lowest location of the sloping surface, and prevent the bulk density of the toner at the lowest location from becoming excessively high.

The gas blowout parts in this embodiment include a relay part 33A, a porous material 33B, four chambers 33C1 to 33C4, etc. The gas blowout parts serve to eject air (gas) to the inside of the powder container 31. The lateral cross section of the gas blowout parts (which cross section is perpendicular to the air flowing direction) is formed generally in the shape of a rectangle. The porous material 33B of the gas blowout part (fluid membrane) is disposed on the bottom base which is directly in contact with the toner T in the powder container 31. The air sent out from the air pump 24 of the powder supplying device body 21 is sent to the porous material 33B through the tubes 44*a* and 44*b* and the chambers 33C1 to 33C4, and the porous material 33B serves as an exhaust nozzle of the air into the inside of the powder container 31.

The porous material 33B in this embodiment contains fine porous material particles which let air pass through. The porous material 33B is formed so that the open area ratio is in a range of 5 to 40% (which is preferably in a range of 10 to 20%), and the average opening diameter is in a range of 0.3-20 micrometers (which is preferably in a range of 5-15 micrometers). The porous material 33B is formed so that the ratio of the average hole diameter of the holes of the porous material to the volume average particle diameter of the toner is in a range of 0.1 to 5 times (which is preferably in a range of 0.5 to 3 times).

Examples of the porous material 33B in this embodiment may include glass, a sintered body of resin particles, a porous resin material, such as a photo-etched resin or a thermally punched resin, a sintered metal body, a punched sheet metal body, a net laminated body, and a metallic material having selectively fused holes which are formed by heating a copper plate, which is produced so that metal copper is deposited around easily melting metallic yarns and the easily melting metallic yarns are embedded through the copper plate through an electrochemical process, such that the easily melting metallic yarns are removed selectively.

By ejecting air towards the toner T in the powder container 31 through the porous material 33B, the bulk density of the toner can be reduced constantly, and the toner can be mobilized, thereby preventing bridge formation of the toner. The weight per toner particle is small enough and the air pressure applied to the porous material 33B is high enough. Even if the toner enters the hole parts of the porous material 33B, the toner will not enter the chamber, thereby preventing the hole parts of the porous material 33B from being clogged by the toner.

The chamber which is disposed under the porous material 33B includes the four chambers 33C1 to 33C4 which are provided independently of each other. The 1st chamber 33C1 and the second chamber 33C2 are adjacent to the relay part 33A which is disposed at the lowest location of the powder container bottom (sloping surface). The air from the air pump 24 after it is branched at the relay part 33A via the connection terminals 53*b* and 54*b* and the second tube 44*b* is sent out to the 1st chamber 33C1 from the ejection hole 44*b*1. The air from the air pump 24 after it is branched at the relay part 33A via the connection terminals 53*b* and 54*b* and the second tube 44*b* is sent out to the second chamber 33C2 from the ejection hole 44*b*2. The air which is discharged to the 1st chamber 33C1 and the second chamber 33C2 is further discharged to the vicinity of the lowest location of the powder container bottom (sloping surface) through the porous material 33B.

The 3rd chamber 33C3 and the 4th chamber 33C4 are adjacent to the 1st chamber 33C1 and the second chamber 33C2, respectively. The air from the air pump 24 after it is branched at the relay part 33A through the connection terminals 53*a* and 54*a* and the 1st tube 44*a* is sent out to the 3rd chamber 33C3 from the ejection hole 44*a*1. The air from the air pump 24 after it is branched at the relay part 33A through the connection terminals 53*a* and 54*a* and the 1st tube 44*a* is sent out to the 4th chamber 33C4 from the ejection hole 44*a*2. The air which is discharged to the 3rd chamber 33C3 and the 4th chamber 33C4 is further discharged through the porous material 33B to other locations different than the vicinity of the lowest location of the powder container bottom (sloping surface).

The area of the 1st chamber 33C1 and the second chamber 33C2 (which is the area of the contact surface which touches the porous material 33B) or the volume of the 1st chamber 33C1 and the second chamber 33C2 is set up to be smaller than the area or the volume of the 3rd chamber 33C3 and the 4th chamber 33C4.

The gas blowout part in this embodiment is thus constituted. The gas blowout part is provided so that a flow rate of gas per unit area near the lowest location of the sloping surface (which is the location where the 1st chamber 33C1 and the second chamber 33C2 are disposed) is larger than a flow rate of gas per unit area at other locations of the sloping surface (which are the locations where the 3rd chamber 33C3 and the 4th chamber 33C4 are disposed).

It is likely that the bulk density of the toner in the vicinity of the lowest location of the sloping surface is higher than that at other locations of the sloping surface (which are upper locations including the uppermost position). Thus, in this embodiment, a difference in the flow rate of gas is provided in the gas blowout part in accordance with the location of the sloping surface, and it is possible for this embodiment to equalize the fluidity of the toner for the whole sloping surface efficiently.

The suction tube 37 (suction opening) of the powder transport unit is disposed above the relay part 33A (the lowest location of the sloping surface). The suction tube 37 is connected to the end (suction opening) of the pump 22 via the suction tube 40 and the connection terminals 50 and 51. The other end (ejection hole) of the pump 22 is connected to the toner hopper 9 of the image forming device body via the tube 41. And when the pump 22 works, the toner T in the powder container 31 is attracted from the suction opening of the suction tube 37, and the toner is transported to the toner hopper 9 (the powder receiving device) through the pump 22.

The pump 22 of the powder transport unit is disposed above the powder container 31 and the toner hopper 9. That is, the toner T in the powder container 31 is attracted upwards from the suction tube 37 (the inside diameter of which is in a range of 6-8 mm) which is disposed near the lowest location of the powder container 31. Therefore, the toner T in the powder container 31 can be attracted and transported efficiently.

Even when the suction tube 40 is damaged or disconnected, it is possible to avoid the situation that a large amount of the toner in the powder container 31 disperses. In such a case, only a small amount of the toner which has passed along the inside of the suction tube 40 disperses.

The toner T attracted by the pump 22 is discharged to the toner hopper 9 which is disposed in the location lower than the pump 22 as shown in FIG. 2. Therefore, the toner can easily be transported by the height difference with a small discharging force, even if it is the case in which there is a long distance between the pump 22 and the toner hopper 9.

Figure 7:
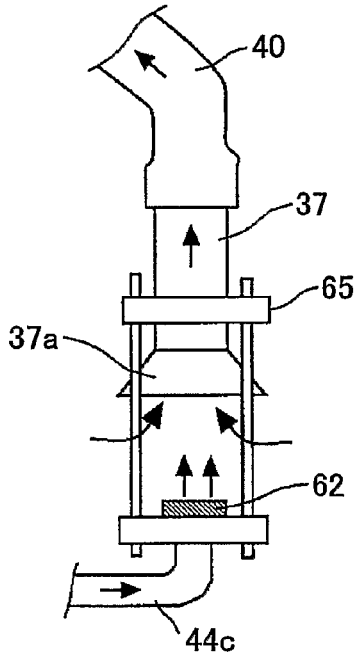
FIG. 7 is a partial enlarged diagram showing the vicinity of a suction tube.

As shown in FIG. 7, the suction tube 37 is fixed to a holding member 65 which is supported by the column 61. Disposed under the suction tube 37 is a second gas blowout part 62 which is held by the holding member 65. The holding member 65 (and the column 61) serves to position the location of the second gas blowout part 62 to the suction tube 37, and serves to position the location of the suction tube 37 in the powder container 31.

The second gas blowout part 62 is provided to discharge the air sent out from the air pump 24, to the vicinity of the suction opening of the suction tube 37 (and to the vicinity of the remaining toner sensor 38) through the connection terminals 53*c* and 54*c* and the 3rd tube 44*c*. And the second gas blowout part 62 is formed by the porous material (in which a chamber may be provided).

The porous material of the second gas blowout part 62 is the same as the porous material 33B of the previously mentioned gas blowout part. Accordingly, the toner near the suction opening of the suction tube 37 is mobilized, and the ease of transporting of the toner by the powder transport units 22, 37, 40 and 41 will be increased. Moreover, the toner in the vicinity of the remaining toner sensor 38 is mobilized, and the detection performance of the remaining toner sensor 38 will be stabilized.

In this embodiment, the forced air is discharged to both the vicinity of the remaining toner sensor 38 and the vicinity of the suction opening of the suction tube 37 by using the second gas blowout part 62.

Alternatively, a first gas blowout part for ejecting the forced air to the vicinity of the suction opening of the suction tube 37, and a second gas blowout part for ejecting the forced air to the vicinity of the remaining toner sensor 38 may be provided independently.

Alternatively, the second gas blowout part 62 in this embodiment may be formed integrally with the previously mentioned gas blowout part provided at the bottom of the powder container 31.

As shown in FIG. 7, in this embodiment, a funnel-like flow correcting member 37*a* is attached to the head end of the suction tube 37. Therefore, the toner suction performance relating to the suction opening of the suction tube 37 will be increased with the flow correcting member 37*a*.

As shown in FIG. 5 and FIG. 6, an opening and a filter 35 which covers the opening are provided in the top surface of the powder container 31. The filter 35 serves to prevent the internal pressure in the powder container 31 from rising, and prevent the toner in the powder container 31 from leaking out of the powder container 31. The material of the filter 35 may be the same as the porous material 33B mentioned above. Alternatively, "Gore-Tex" (the registered trademark, the Japan Gore-Tex product) which is a continuation porous-structure substance made of fluororesin may also be used as material of the filter 35. If the filter 35 is disposed above from the upper limit line of the toner when the powder container 31 is completely filled with the toner, the filter 36 may be disposed at any location other than the top surface of the powder container 31 (for example, a side surface).

Next, the remaining toner sensor 38 in this embodiment which constitutes the first detection unit will be explained.

Figure 8:
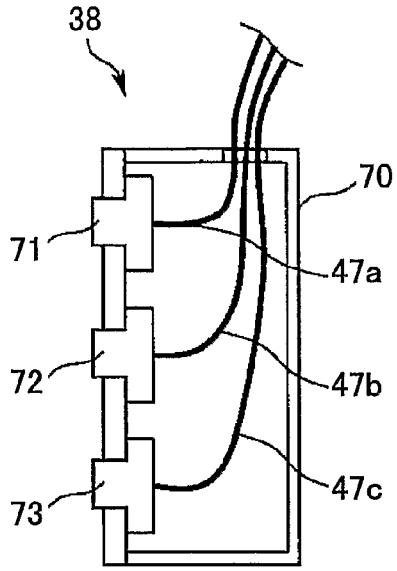
FIG. 8 is a cross-sectional diagram showing a remaining toner sensor.

As shown in FIG. 8, the remaining toner sensor 38 includes three piezoelectric sensors 71-73 which are disposed side by side at separate locations in the perpendicular direction. These piezoelectric sensors 71-73 are held in the case 70 which is supported by the column 61. Three cables 47*a*-47*c* are electrically connected to the three piezoelectric sensors 71-73 respectively, and they are bundled together within the case 70. The cables 47 are supported by the column, and electrically connected through the connection terminals 57 and 58 (connectors) and the cable 48 to the control unit of the image forming device 1.

The remaining toner sensor 38 in this embodiment is provided so that the remaining toner in the powder container 31 is classified into three quantity levels and the respective quantity levels of the remaining toner are notified to a user. Specifically, when the piezoelectric sensor 71 disposed at the upper location of the remaining toner sensor 38 detects that no toner remains in that location (height) of the sensor 71, a message indicating that the quantity of the remaining toner in the powder container 31 has decreased to the pre-near-end quantity level is displayed on the display screen of the image forming device 1 (warning indication of pre-near-end condition). Subsequently, when the piezoelectric sensor 72 disposed at the intermediate location of the remaining toner sensor 38 detects that no toner remains in that location (height) of the sensor 72, a message indicating that the quantity of the remaining toner in the powder container 31 has decreased to the near-end quantity level is displayed on the display screen of the image forming device 1 (warning indication of near-end condition). Finally, when the piezoelectric sensor 73 disposed at the lower location of the remaining toner sensor 38 that no toner remains in that location (height)

of the sensor 73, a message indicating that the quantity of the remaining toner in the powder container 31 has decreased to the toner-end quantity level is displayed on the display screen of the image forming device 1 (warning indication of toner end). Concurrently with the warning indication of toner end, the pump 22 is controlled to stop the toner attraction operation until the exchange work of the powder container 31 is completed.

The remaining toner sensor 38 which constitutes the detection unit is disposed outside the suction tube 37, and it is possible to prevent the problem that the toner in the suction tuber 37 turns into a block of toner clogging the suction tube 37. The remaining toner sensor 38 is disposed above the suction opening of the suction tube 37, and it is possible to prevent the problem that only air is attracted from the suction tube 37. Namely, using the remaining toner sensor 38, the toner-end signal is transmitted to the control unit when the toner still remains in the upper location of the suction opening, and the pump 22 is controlled to stop the toner attraction operation. This prevents the problem that only air is attracted from the suction tube 37 (or air is attracted in a condition that the mixture ratio of the toner to air is very small).

Since the remaining toner sensor 38 is disposed above the gas blowout part 33, it is possible to raise the detecting accuracy of the remaining toner in the powder container. That is, the toner mobilized by the gas blowout part 33 is sensed by the remaining toner sensor 38, and the quantity of the remaining toner can be stably detected with good accuracy. Since the remaining toner sensor 38 is disposed above the lowest location of the gas blowout part 33 (sloping surface), it is possible to detect correctly the quantity of the remaining toner in the powder container 31 which is attracted efficiently and economically by the suction tube 37 similarly disposed above the lowest location.

The location of the above-mentioned remaining toner sensor 38 in the powder container 31 is correctly set up by the column 61 and the holder 70. Since the second gas blowout part 62 is disposed under the remaining toner sensor 38 as mentioned above, the toner in the vicinity of the remaining toner sensor 38 is mobilized, and the detection accuracy of the remaining toner sensor 38 is stabilized.

As explained above, in this embodiment, the toner is attracted from the suction opening of the suction tube 37 by the powder transport units 22, 37, 40 and 41 while air is discharged from the bottom of the powder container 31 by the gas blowout part 33, and the remaining toner sensor 38 (which is the detection unit) is provided to detect the remaining toner in the powder container 31. It is possible for the powder supplying device of this embodiment to attain fine adjustment of the amount of toner supplied, without damaging the toner. And it is possible to prevent the scattering of the toner and prevent the inoperative condition of the powder receiving device in the image forming device 1 from arising.

Figure 9:
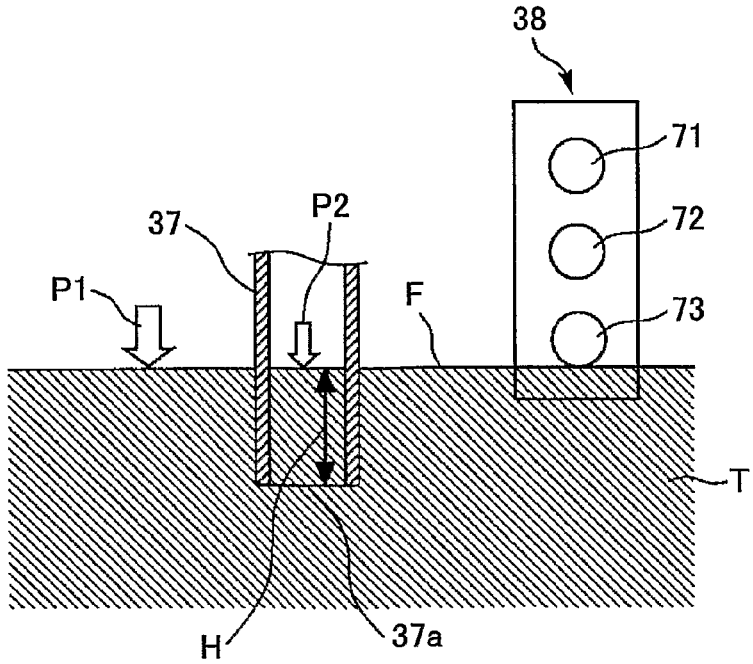
FIG. 9 is a diagram showing the suction tube and the remaining toner sensor of a powder supplying device in an embodiment of the invention.

A description will be given of another embodiment of the invention with reference to FIG. 9. FIG. 9 shows the suction tube and the remaining toner sensor of a powder supplying device in this embodiment. Especially, the positional relationship in the height direction between the suction tube and the remaining toner sensor is illustrated in FIG. 9.

Similar to the embodiment of FIG. 8, the remaining toner sensor 38 in this embodiment is disposed above the suction opening 37*a* of the suction tube 37 as shown in FIG. 9. The remaining toner sensor 38 in this embodiment which constitutes the detection unit is provided to detect a toner-end quantity level prior to reaching a condition that, as a result of falling of the powder surface (toner surface) by consumption of the toner T contained in the powder container 31, no toner remains in the suction tube 37 (or no toner remains in the vicinity of the suction opening 37*a*). That is, when the toner in the suction tube 37 is located at a fixed height H (H>0) from the suction opening 37*a* (which is the condition shown in FIG. 9), detection of a toner-end quantity level is performed by the remaining toner sensor 38, so that operation of the powder supplying device 20 (pump 22) is stopped.

Specifically, in the remaining toner sensor 38 of this embodiment, the piezoelectric sensor 73 for detection of the toner-end quantity level is disposed in a location higher than the powder surface F of the toner in the powder container which is located at the height H of the toner in the suction tube 37 that does not yet reach the location of the suction opening 37*a*. The positional relationship between the powder surface F and the toner height H in the suction tube 37 is essentially determined by the pressure P1 acting on the powder surface F and the pressure P2 acting on the toner in the suction tube 37.

With the use of the structure of the remaining toner sensor 38 mentioned above, it is possible to prevent the problem that only air is attracted from the suction opening 37*a* of the suction tube 37 and the toner from the toner hopper 9 disperses. That is, if the pump 22 works in the condition that there is no toner in the vicinity of the suction opening 37*a* of the suction tube 37 and only air is attracted from the suction tube 37 by the pump 22, a large amount of air will be fed into the toner hopper 9 (the powder receiving device). And if a large amount of air is fed into the toner hopper 9, the toner will disperse from the clearance between the toner hopper 9 and the housing which covers the toner hopper 9.

To obviate the problem, in this embodiment, the detection of a toner-end quantity level is performed by the remaining toner sensor 38 and operation of the pump 22 is suspended prior to reaching the condition that no toner remains in the vicinity of the suction opening 37*a*, and it is possible to prevent the problem that only air is attracted from the suction tube 37.

In the above-mentioned embodiment, the toner is attracted from the suction opening of the suction tube 37 by the powder transport units 22, 37, 40 and 41 while air is discharged from the bottom of the powder container 31 by the gas blowout part 33, and the remaining toner sensor 38 (which is the detection unit) is provided to detect the remaining toner in the powder container 31. It is possible for the powder supplying device of this embodiment to attain fine adjustment of the amount of toner supplied, without damaging the toner. And it is possible to prevent the scattering of the toner and prevent the inoperative condition of the powder receiving device in the image forming device 1 from arising.

Figure 10:
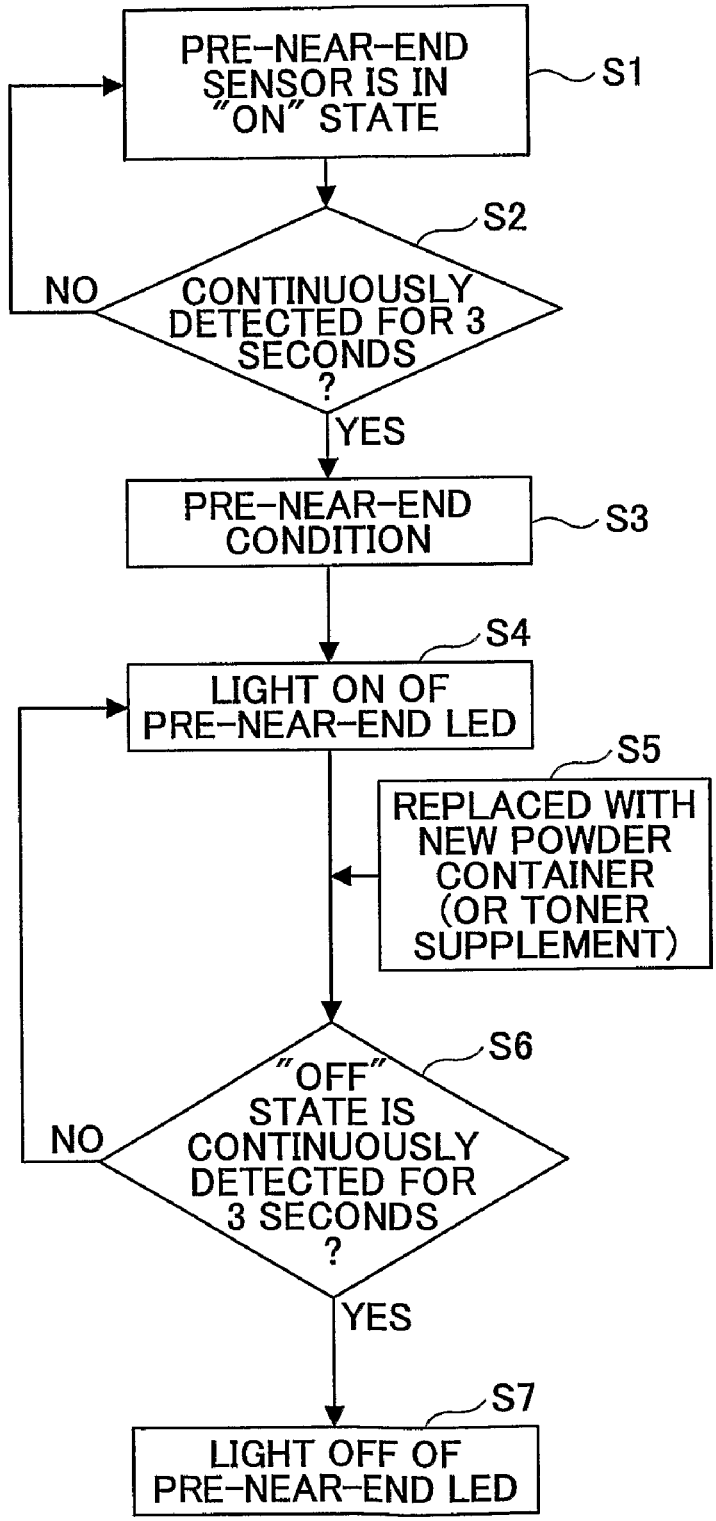
FIG. 10 is a flowchart for explaining the control process performed by a powder supplying device in an embodiment of the invention using a pre-near-end sensor.
Figure 11:
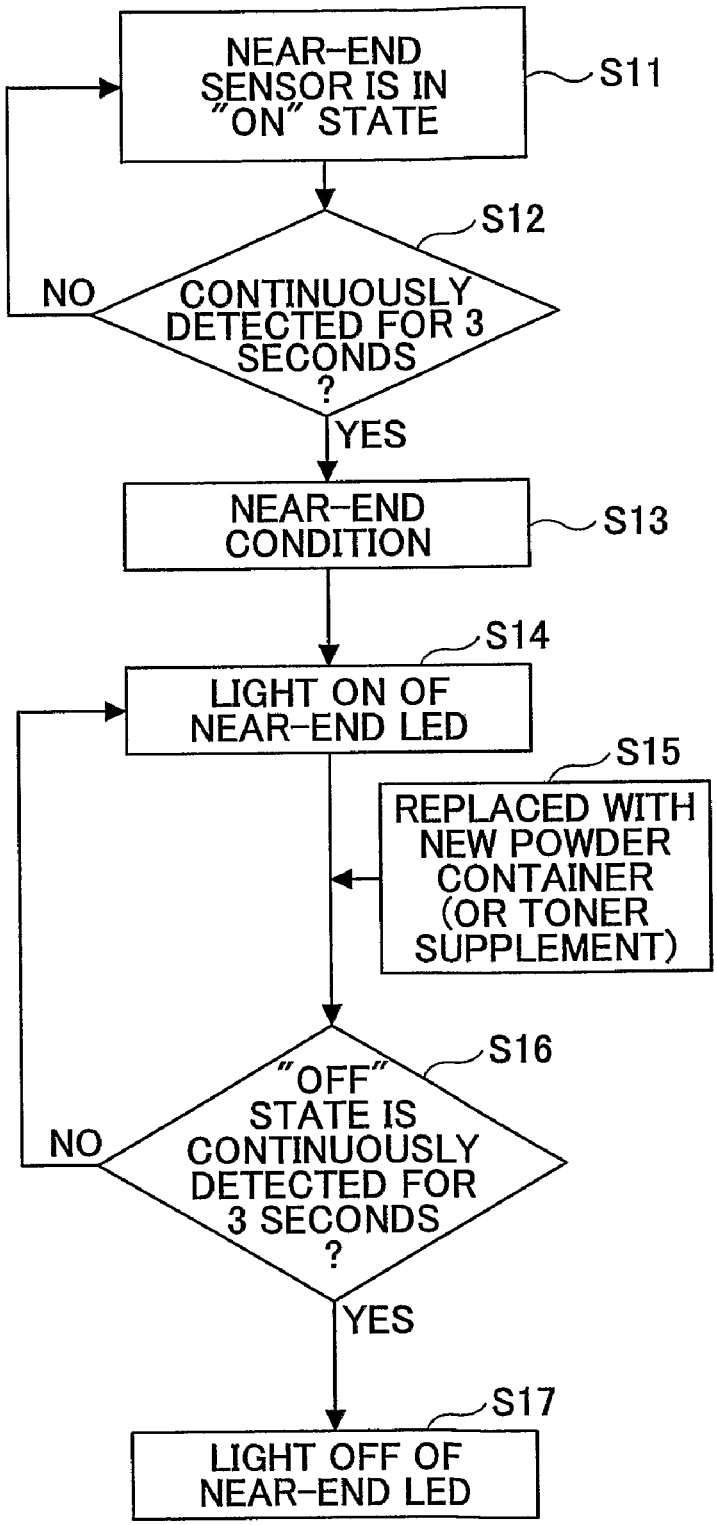
FIG. 11 is a flowchart for explaining the control process performed by the powder supplying device of this embodiment using a near-end sensor.
Figure 12:
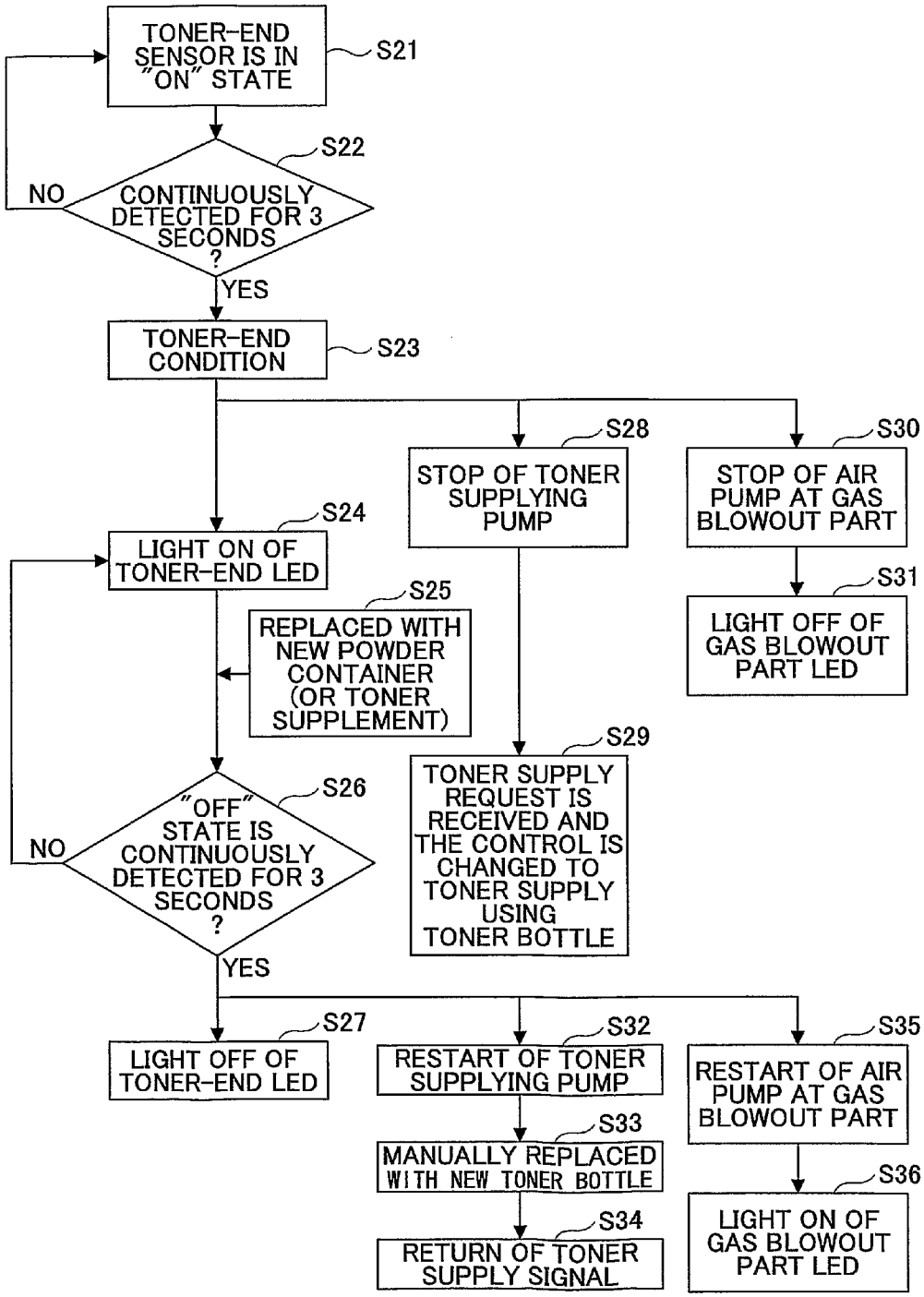
FIG. 12 is a flowchart for explaining the control process performed by the powder supplying device of this embodiment using a toner-end sensor.

A description will be given of another embodiment of the invention with reference to FIG. 10-FIG. 12. FIG. 10-FIG. 12 are flowcharts for explaining the control process which is performed by a powder supplying device in this embodiment.

Similar to the previous embodiment, the remaining toner sensor 38 in this embodiment is provided with the three piezoelectric sensors 71-73 so that the remaining toner in the powder container 31 is classified into three quantity levels and the respective quantity levels of the remaining toner are notified to a user. Specifically, the piezoelectric sensor 71 disposed at the upper location of the remaining toner sensor 38 is a pre-near-end sensor which detects the pre-near-end quantity level of toner, the piezoelectric sensor 72 disposed at the intermediate location of the remaining toner sensor 38 is a near-end sensor which detects the near-end quantity level of toner, and the piezoelectric sensor 73 disposed at the lower location of the remaining toner sensor 38 is a toner-end sensor which detects the toner-end quantity level of toner. The powder supplying device in this embodiment includes the remaining toner sensor 38 (the piezoelectric sensors 71-73) which is provided to detect the quantity of the remaining toner after the output of each of the piezoelectric sensors 71-73 is continuously detected for a predetermined time.

FIG. 10 is a flowchart for explaining the control process which is performed by the powder supplying device of this embodiment using the piezoelectric sensor 73 as a pre-near-end sensor.

In the control process of FIG. 10, the piezoelectric sensor 73 performs detection of a pre-near-end condition and the output of the piezoelectric sensor 73 is set in ON state (step S1). It is determined whether the pre-near-end condition (the ON state of the output of the piezoelectric sensor 73) is continuously detected for 3 seconds (step S2). When the pre-near-end condition is not continuously detected for 3 seconds, the control is returned to the above step S1.

On the other hand, when the pre-near-end condition is continuously detected for 3 seconds, it is determined that the remaining toner in the powder container is actually in the pre-near-end condition (step S3). And the pre-near-end LED (not illustrated) which is provided in the powder supplying device 20 is turned ON, and the warning indication of pre-near-end condition appears on the display screen of the image forming device 1 (step S4).

Subsequently, the replacement of the powder container 31 with a new powder container or the toner supplement to the powder container 31 is performed (step S5). After the step S5 is performed, it is determined whether the OFF state of the output of the piezoelectric sensor 73 is continuously detected for 3 seconds (step S6).

When the OFF state of the output of the piezoelectric sensor 73 is not continuously detected for 3 seconds, the control is returned to the above step S4.

On the other hand, when the OFF state of the output of the piezoelectric sensor 73 is continuously detected for 3 seconds, it is determined that the remaining toner in the powder container is actually not in the pre-near-end condition. The pre-near-end LED is turned OFF and the warning indication on the display screen of the image forming device 1 disappears (step S7).

FIG. 11 is a flowchart for explaining the control process which is performed by the powder supplying device of this embodiment using the piezoelectric sensor 72 as a near-end sensor.

In the control process of FIG. 11, the piezoelectric sensor 72 performs detection of a near-end condition and the output of the piezoelectric sensor 72 is set in ON state (step S11). It is determined whether the near-end condition (the ON state of the output of the piezoelectric sensor 72) is continuously detected for 3 seconds (step S12). When the near-end condition is not continuously detected for 3 seconds, the control is returned to the above step S11.

On the other hand, when the near-end condition is continuously detected for 3 seconds, it is determined that the remaining toner in the powder container is actually in the near-end condition (step S13). The near end LED (not illustrated) which is provided in the powder supplying device 20 is turned ON and the warning indication of near-end condition appears on the display screen of the image forming device 1 (step S14).

Subsequently, the replacement of the powder container 31 with a new powder container or the toner supplement to the powder container 31 is performed (step S15). After the step S15 is performed, it is determined whether the OFF state of the output of the piezoelectric sensor 72 is continuously detected for 3 seconds (step S16).

When the OFF state of the output of the piezoelectric sensor 72 is not continuously detected for 3 seconds, the control is returned to the step S14.

On the other hand, when the OFF state of the output of the piezoelectric sensor 72 is continuously detected for 3 seconds, it is determined that the remaining toner in the powder container is actually not in the near-end condition. The near-end LED is turned OFF and the warning indication on the display screen of the image forming device 1 disappears (step S17).

FIG. 12 is a flowchart for explaining the control process which is performed by the powder supplying device using the piezoelectric sensor 71 as a toner-end sensor.

In the control process of FIG. 12, the piezoelectric sensor 71 performs detection of a toner-end condition and the output of the piezoelectric sensor 71 is set in ON state (step S21). It is determined whether the toner-end condition (the ON state of the output of the piezoelectric sensor 71) is continuously detected for 3 seconds (step S22). When the toner-end condition is not continuously detected for 3 seconds, the control is returned to the above step S21.

On the other hand, when the toner-end condition is continuously detected for 3 seconds, it is determined that the remaining toner in the powder container is actually in the toner-end condition (step S23). The toner-end LED (not illustrated) which is provided in the powder supplying device 20 is turned ON, and the warning indication of toner-end condition appears on the display screen of the image forming device 1 (step S24).

Moreover, when the toner-end condition is determined at the step S23, operation of the toner supplying pump 22 is stopped (step S28). And if the toner supply request signal is received according to the result of detection by the piezoelectric sensor provided in the toner hopper 9, the control is changed from the operation to supply toner from the powder supplying device 20 to the toner hopper 9 to the operation to supply toner from the toner bottle 19 (toner container) to the toner hopper 9 (step S29).

Moreover, when the toner-end condition is determined at the step S23, operation of the air pump 24 provided for the gas blowout part is stopped (step S30). And the gas blowout part LED (not illustrated) which is provided in the powder supplying device 20 is turned OFF (step S31). The gas blowout part LED is provided so that the ON state of the gas blowout part LED indicates that the gas blowout part 33 is working.

Subsequently, the replacement of the powder container 31 with a new powder container or the toner supplement to the powder container 31 is performed (step S25). After the step S25 is performed, it is determined whether the OFF state of the output of the piezoelectric sensor 71 is continuously detected for 3 seconds (step S26).

When the OFF state of the output of the piezoelectric sensor 71 is not continuously detected for 3 seconds, the control is returned to the step S24.

On the other hand, when the OFF state of the output of the piezoelectric sensor 71 is continuously detected for 3 seconds, it is determined that the remaining toner in the powder container is actually not in the toner-end condition. The toner-end LED is turned OFF and the warning indication on the display screen of the image forming device 1 disappears (step S27).

Moreover, when it is determined that it is not in the toner-end condition, operation of the toner supplying pump 22 is restarted (step S32). The replacement work of the toner bottle 19 (toner container) is performed manually (step S33). And the toner supply signal which enables the toner supply operation from the powder supplying device 20 to the toner hopper 9 is returned (step S34).

Moreover, when it is determined that it is not in the toner-end condition, operation of the air pump 24 provided for the gas blowout part is restarted (step S35). And the gas blowout part LED is turned ON (step S36).

As explained above, the powder supplying device of this embodiment includes the remaining toner sensor 38 (the piezoelectric sensors 71-73) which is provided to detect the quantity of the remaining toner after the output of each of the piezoelectric sensors 71-73 is continuously detected for a predetermined time (which is preferably more than 1 second). The quantity of the remaining toner is determined based on the result of continuous detection of the sensor output for the predetermined time, and erroneous detection by the remaining toner sensor 38 due to chattering can be prevented.

The toner in the powder container 31 is mobilized with the air discharged from the gas blowout part 33. For this reason, when detecting the mobilized toner containing air by the remaining toner sensor 38, erroneous detection (chattering) may arise according to the condition of the toner at the instant of detection. To obviate the problem, this embodiment is provided so that, only when the same condition is detected continuously for a predetermined time (which is, in this embodiment, set to 3 seconds) using the output of the remaining toner sensor 38 (piezoelectric sensors 71-73), it is determined that the quantity of the remaining toner is in one of the three conditions (pre-near-end condition, near-end condition, toner-end condition), and the detection accuracy by the remaining toner sensor 38 can be increased.

As explained above, in this embodiment, the toner is attracted from the suction opening of the suction tube 37 by the powder transport units 22, 37, 40 and 41 while air is discharged from the bottom of the powder container 31 by the gas blowout part 33, and the remaining toner sensor 38 (which is the detection unit) is provided to detect the remaining toner in the powder container 31. It is possible for the powder supplying device of this embodiment to attain fine adjustment of the amount of toner supplied, without damaging the toner. And it is possible to prevent the scattering of the toner and prevent the inoperative condition of the powder receiving device in the image forming device 1 from arising.

In addition, in this embodiment, the quantity of the remaining toner is determined based on the result of continuous detection of the output of the remaining toner sensor 38 (piezoelectric sensors 71-73) for a predetermined time. Alternatively, the quantity of the remaining toner may be determined based on the result of successive detection of the output of the remaining toner sensor 38 (piezoelectric sensors 71-73) for a predetermined number of times. For example, in such alternative embodiment, only when the same condition of the output of the remaining toner sensor 38 is detected successively 3 times, it is determined that the quantity of the remaining toner is in the detected condition.

Figure 13:
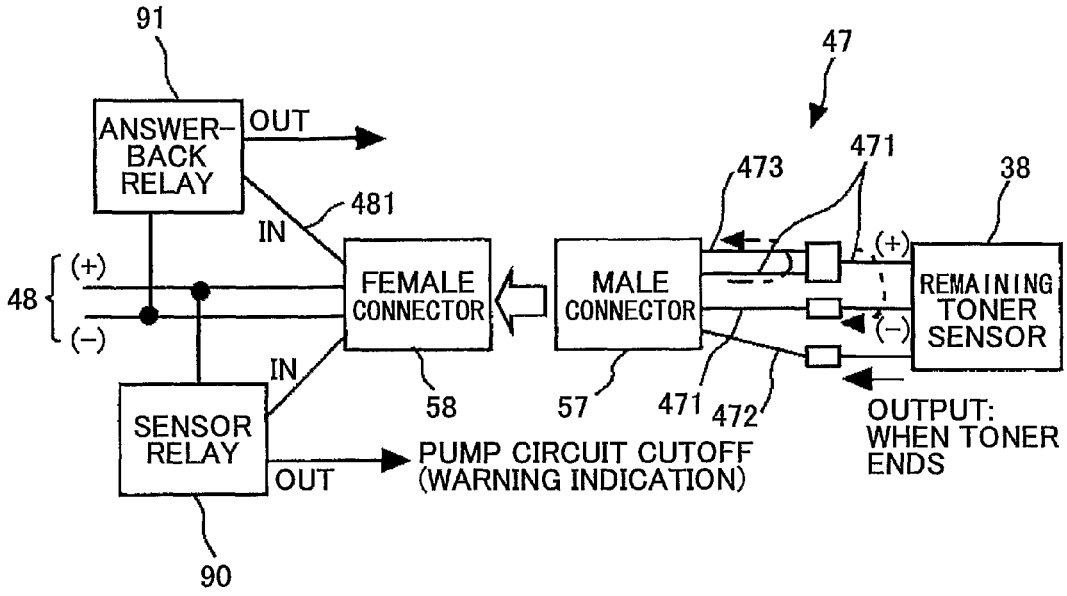
FIG. 13 is a diagram showing the circuit of a powder supplying device in an embodiment of the invention.
Figure 14:
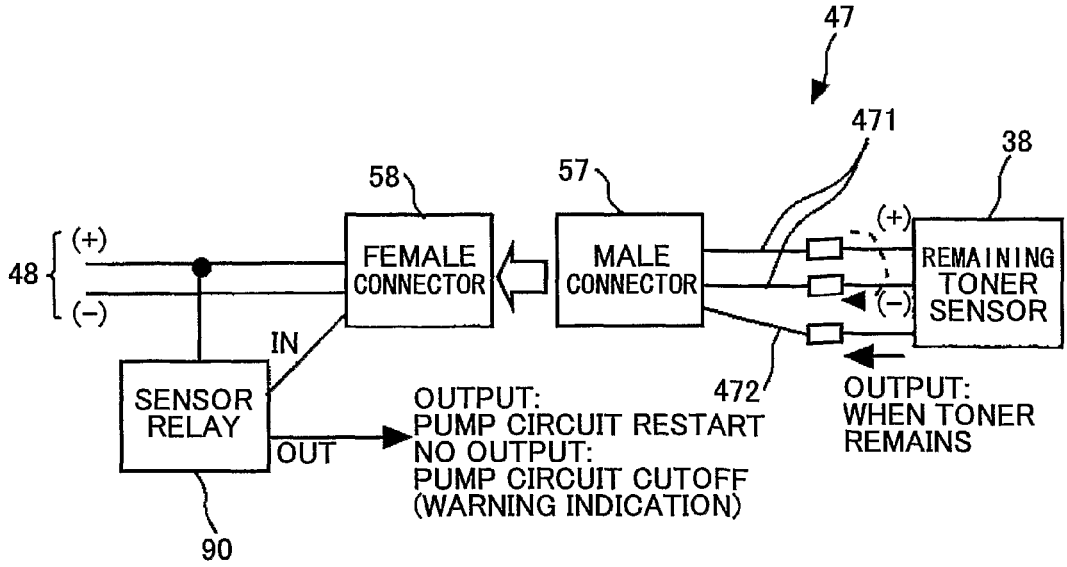
FIG. 14 is a diagram showing another circuit of the powder supplying device.

A description will be given of another embodiment of the invention with reference to FIG. 13 and FIG. 14. FIG. 13 and FIG. 14 show the circuit of a powder supplying device in this embodiment.

In this embodiment, the remaining toner sensor 38 is electrically connected through the cable 47, the connection terminals 57 and 58 (connectors) and the cable 48 to the control unit of the image forming device 1, similar to the preceding embodiment. Specifically, when attaching the powder container 31 to or detaching the powder container 31 from the powder supplying device body 21, the connection or disconnection of the connection terminal 57 on the side of powder container 31 and the connection terminal 58 on the side of the powder supplying device body 21 is performed.

A second detection unit which detects whether the remaining toner sensor 38 is electrically connected to the powder supplying device body 21 is provided in the powder supplying device in this embodiment. And when the electric connection of the remaining toner sensor 38 cannot be detected by the second detection unit, the powder supplying device is controlled to stop operation.

FIG. 13 shows the electric circuit of the powder supplying device in which an answerback circuit is provided as the second detection unit. As shown in FIG. 13, when electrical connection is established between the connection terminal 57 (male connector) on the side of powder container 31 and the connection terminal 58 (female connector) on the side of the powder supplying device body 21, the electric power (for example, 5V) is supplied to the remaining toner sensor 38 through the power supply (+/−) harnesses 471 and 48. And if the remaining toner sensor 38 detects a toner end condition when the connectors 57 and 58 are connected together, the output signal of the remaining toner sensor 38 is inputted into the sensor relay 90 through the detection signal harness 472, so that the pump circuit cutoff (stop of operation of the pump 22) is performed and the warning indication appears the display screen of the image forming device 1.

In this embodiment, in order to detect electric connection of the remaining toner sensor 38, the answer-back relay 91 and the answer-back harness 473 are provided. The answer-back harness 473 is connected to the power-supply (+) harness 471. Thereby, when the connectors 57 and 58 are connected together, the voltage is generated and the current is returned through the answer-back harness 473 to the answer-back relay 91. And when the current is inputted into the answer-back relay 91, the circuit is enabled to start operation of the pump 22 (the pump 22 is set in the operative condition).

On the other hand, when the connectors 57 and 58 are not connected or when the cables 47 and 48 are disconnected, the pump circuit cutoff (stop of operation of the pump 22) is performed and the warning indication appears on the display screen of the image forming device 1 without inputting the current into the answer-back relay 91.

Thus, even when connection of the connectors 57 and 58 is not performed or when open circuit or separation of the cables 47 and 48 arises in the exchange work of the powder container 31 due to operator's carelessness, such a condition is detected by the answerback circuit (the second detection unit) and operation of the pump 22 is stopped. It is possible to prevent the problem that the pump 22 works in the condition that there is no toner in the powder container 31.

If the toner-end detection signal of the remaining toner sensor 38 is not sent to the sensor relay 90 and operation of the pump 22 is continued under the toner-end condition, only air is supplied to the toner hopper 9 excessively and the scattering of the toner may arise. With the use of the circuit of this embodiment, it is possible to avoid the problem certainly.

FIG. 14 shows another circuit of the powder supplying device in which the second detection unit is provided. As shown in FIG. 14, when electrical connection is established between the connection terminal 57 (male connector) on the side of the powder container 31 and the connection terminal 58 (female connector) on the side of the powder supplying device body 21, the electric power is supplied to the remaining toner sensor 38 through the power supply (+/−) harnesses 471 and 48. And if the remaining toner sensor 38 detects that there is a toner when the connectors 57 and 58 are connected together, the output signal of the remaining toner sensor 38 is inputted into the sensor relay 90 through the detection signal harness 472, so that the circuit for working the pump 22 is enabled (restart of operation of the pump 22).

If the remaining toner sensor 38 detects a toner end condition when the connectors 57 and 58 are connected together, the pump circuit cutoff is performed (stop of operation of the pump 22) and the warning indication appears on the display screen of the image forming device 1, without inputting a signal into the sensor relay 90.

On the other hand, when the connectors 57 and 58 are not connected or when the cables 47 and 48 are disconnected, the pump circuit cutoff is performed (stop of operation of the pump 22) and the warning indication appears on the display screen of the image forming device 1, without inputting a signal (which indicates presence of toner) into the sensor relay 90.

Even when connection of the connectors 57 and 58 is not performed or when open circuit or separation of the cables 47 and 48 arises in the exchange work of the powder container 31 due to operator's carelessness, the sensor relay (the second detection unit) detects such a condition and operation of the pump 22 is stopped. It is possible to prevent the problem that the pump 22 works in the condition that there is no toner in the powder container 31.

As explained above, in this embodiment, the toner is attracted from the suction opening of the suction tube 37 by the powder transport units 22, 37, 40 and 41 while air is discharged from the bottom of the powder container 31 by the gas blowout part 33, and the remaining toner sensor 38 (which is the detection unit) is provided to detect the remaining toner in the powder container 31. It is possible for the powder supplying device of this embodiment to attain fine adjustment of the amount of toner supplied, without damaging the toner. And it is possible to prevent the scattering of the toner and prevent the inoperative condition of the powder receiving device in the image forming device 1 from arising.

Figure 15:
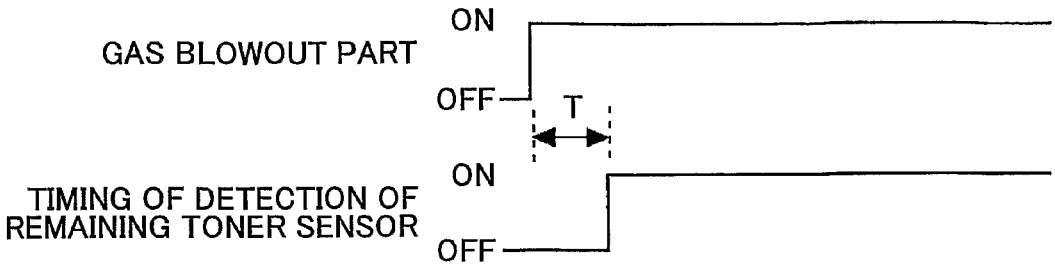
FIG. 15 is a timing chart for explaining the control process performed by a powder supplying device in an embodiment of the invention.

A description will be given of another embodiment of the invention with reference to FIG. 15. FIG. 15 is a timing chart for explaining the control process performed by a powder supplying device in this embodiment.

In this embodiment, the fluidity of the toner contained in the powder container 31 is increased by ejecting air from the gas blowout part 33, similar to the preceding embodiment.

As shown in FIG. 15, the powder supplying device of this embodiment is controlled so that, after a predetermined time T has elapsed from a start of operation of the gas blowout part 33, the remaining toner sensor 38 detects a remaining toner in the powder container 31. In other words, the powder supplying device of this embodiment is controlled so that, during the predetermined time T from the start of operation of the gas blowout part 33, the detection result by the remaining toner sensor 38 is disregarded (cancellation).

In this embodiment, the time T during which the detection result of the remaining toner sensor 38 is canceled is set up to be in a range of 5 to 60 minutes (which is preferably in a range of 15 to 30 minutes).

If operation of the powder supplying device 20 (gas blowout part 33) is stopped, the powder surface of the toner in the powder container 31 will fall gradually. And if operation of the powder supplying device 20 (gas blowout part 33) is restarted, the powder surface of the toner in the powder container 31 will go up again. After a certain time passes, the powder surface will be stabilized in a predetermined height.

The control performed in this embodiment is to avoid erroneous detection by the remaining toner sensor 38, which may arise immediately after operation of the gas blowout part 33 is started or when the powder surface of toner is unstable. It is possible for the powder supplying device 20 of this embodiment to prevent erroneous detection by the remaining toner sensor 38, which may arise immediately after operation of the gas blowout part 33 is started or when the powder surface of toner is unstable. Thereby, it is possible to prevent wasting of the toner supplied by the powder supplying device 20.

As explained above, in this embodiment, the toner is attracted from the suction opening of the suction tube 37 by the powder transport units 22, 37, 40 and 41 while air is discharged from the bottom of the powder container 31 by the gas blowout part 33, and the remaining toner sensor 38 (which is the detection unit) is provided to detect the remaining toner in the powder container 31. It is possible for the powder supplying device of this embodiment to attain fine adjustment of the amount of toner supplied, without damaging the toner. And it is possible to prevent the scattering of the toner and prevent the inoperative condition of the powder receiving device in the image forming device 1 from arising.

Figure 16:
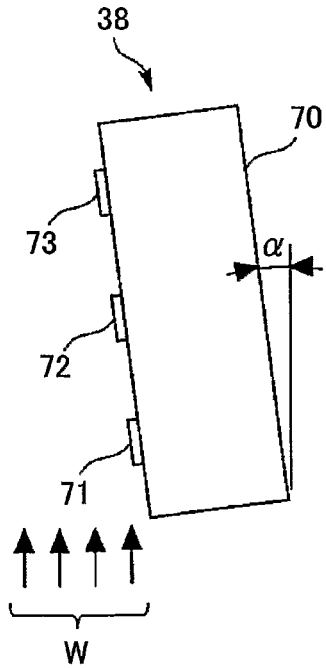
FIG. 16 is a schematic diagram showing the remaining toner sensor of a powder supplying device in an embodiment of the invention.

A description will be given of another embodiment of the invention with reference to FIG. 16. FIG. 16 shows the remaining toner sensor of a powder supplying device in an embodiment of the invention.

In this embodiment, the remaining toner sensor is disposed in an inclined condition, which is different from that in the preceding embodiment.

In this embodiment, the fluidity of the toner contained in the powder container 31 is increased by ejecting the air W from the gas blowout part 33 similar to the preceding embodiment.

As shown in FIG. 16, the remaining toner sensor 38 in this embodiment is inclined so that the air W from the gas blowout part 33 is discharged to the detection surface of the remaining toner sensor 38 (piezoelectric sensors 71-73). Concretely, in this embodiment, the remaining toner sensor 38 is inclined and set up to have an angle of gradient $\alpha$ in a range of 1-45 degrees (which is preferably in a range of 5-15 degrees). The detection surface of the remaining toner sensor 38 is easily cleaned by the air W and the toner near the detection surface of the remaining toner sensor 38 is mobilized efficiently. Thus, the detection performance of the remaining toner sensor 38 will be stabilized.

As described in the embodiment of FIG. 8, even if it is a case where the gas blowout part (the 3rd gas blowout part) which ejects air directly towards the detection surface of the remaining toner sensor 38 is provided apart from the gas blowout part installed in the bottom of powder container 31, the detection surface of the remaining toner sensor 38 is cleaned by the air which is discharged from the 3rd gas blowout part, the detection performance by the remaining toner sensor 38 can be stabilized.

As explained above, in this embodiment, the toner is attracted from the suction opening of the suction tube 37 by the powder transport units 22, 37, 40 and 41 while air is discharged from the bottom of the powder container 31 by the gas blowout part 33, and the remaining toner sensor 38 (which is the detection unit) is provided to detect the remaining toner in the powder container 31. It is possible for the powder supplying device of this embodiment to attain fine adjustment of the amount of toner supplied, without damaging the toner. And it is possible to prevent the scattering of the toner and prevent the inoperative condition of the powder receiving device in the image forming device 1 from arising.

The above-described embodiments are applied to the powder supplying device 20 which supplies a toner to the powder receiving device. Alternatively, this invention may be applied to a powder supplying device which supplies a two-component developer consisting of a toner and a carrier, to the powder receiving device. In such alternative embodiment, a permeability sensor may be used as a detection unit which detects a remaining two-component developer in the powder container.

Moreover, this invention may be applied to the following powder supplying devices:

(1) a powder supplying device (powder supplement device) which supplies a molding material (pellet) to a resin molding machine;

(2) a powder supplying device which transports flour, manure, livestock food, etc.;

(3) a powder supplying device used in the manufacture field which supplies powder or liquid chemicals, tablets, etc.;

(4) a powder supplying device which transports cement;

(5) a powder supplying device which transports industrial coating such that the viscosity of the coating is lowered by dispersing air therein;

(6) a powder supplying device which transport industrial glass beads which are used for road paint components, filler materials of air beds, etc.

If the gas blowout part 33 (fluid membrane) is formed with a resin material, such as PE or PC, and a powder with high hardness, such as 2-component developer or glass beads, is used, the gas blowout part 33 will be damaged with time, which will cause clogging of the holes of the porous. Therefore, in such a case, it is preferred that the gas blowout part is formed with a fine-mesh metallic filter made of sintered copper or iron.

In the above-mentioned embodiments, the powder supplying device 20 is independently installed outside the image forming device 1. Alternatively, the powder supplying device 20 may be formed integrally with the image forming device 1.

In the powder container 31 in each of the above embodiments, a recovery container which contains the waste toner collected by the cleaning unit 8 (for example, a flexible bag-like container having the volume varied according to the amount of the waste toner collected) may be installed. In such a case, transporting of the waste toner from the image forming device 1 to the recovery container can be performed using a pump.

The image forming device (or the powder supplying device 20) in each of the above embodiments can be connected to a LAN (local area network), and the quantity of the remaining toner in the powder container 31 and the operating condition of the image forming device can be monitored through the network. With the use of the monitoring system, a serviceman can easily check the use condition of the image forming device on the user's premise, the exchange time of the powder container, and the abnormalities of the image forming device. For example, this may be carried out as follows. When the detection of a pre-near-end condition is performed by the remaining toner sensor 38 (or the piezoelectric sensor 73), the serviceman goes to the user's premise and conducts the exchange work of the powder container 31 within one or two weeks after the information is acquired from the monitoring system. When the detection of a near-end condition is performed by the remaining toner sensor 38 (or the piezoelectric sensor 72), the serviceman goes to the user's premise and conducts the exchange work of the powder container 31 within one or two days after the information is acquired from the monitoring system. Thus, it is possible to attain fine maintenance of image forming device with the use of the monitoring system.

The present invention is not limited to the above-described embodiments and variations and modifications may be made without departing from the scope of the invention.

Furthermore, the present application is based upon and claims the benefit of priority of Japanese patent application No. 2006-035919, filed on Feb. 14, 2006, and Japanese patent application No. 2006-117172, filed on Apr. 20, 2006, the entire contents of which are incorporated herein by reference.

The invention claimed is:

1. A powder supplying device which supplies powder to a powder receiving device, comprising:

a powder container containing powder therein and provided at a bottom of the powder container with a first gas blowout part for ejecting gas to the inside of the powder container;

a powder transport unit attracting powder contained in the powder container from a suction opening and transporting the powder to the powder receiving device; and a first detection unit provided in the powder container to detect a remaining powder in the powder container, wherein the first detection unit includes a plurality of sensors which are disposed side by side at separate locations in a direction substantially perpendicular to a top surface of the powder container.

2. The powder supplying device according to claim 1, wherein the powder container is provided further with a second gas blowout part for ejecting gas to a vicinity of the first detection unit.

3. The powder supplying device according to claim 2, wherein the second gas blowout part is provided for ejecting gas to a vicinity of the suction opening as well as the vicinity of the first detection unit.

4. The powder supplying device according to claim 2, wherein the second gas blowout part is formed integrally with the first gas blowout part.

5. The powder supplying device according to claim 2, wherein the second gas blowout part has a gas blowout opening including a porous material.

6. The powder supplying device according to claim 1, wherein the first gas blowout part has a gas blowout opening including a porous material.

7. The powder supplying device according to claim 1, wherein the bottom of the powder container is formed into a sloping surface which is inclined so that a lowest location of the sloping surface is around a center of the sloping surface.

8. The powder supplying device according to claim 7, wherein the first gas blowout part is provided so that a flow rate of gas per unit area near the lowest location of the sloping surface is larger than a flow rate of gas per unit area at other locations of the sloping surface.

9. The powder supplying device according to claim 7, wherein the first detection unit is disposed above the lowest location of the sloping surface.

10. The powder supplying device according to claim 1, wherein the powder transport unit comprises:

a suction tube having the suction opening; and a pump connected between the suction tube and the powder receiving device through a tube.

11. The powder supplying device according to claim 10, wherein the pump is disposed above the powder container and the powder receiving device.

12. The powder supplying device according to claim 1, wherein the powder container is provided so that the powder container is attachable to and detachable from the powder supplying device.

13. The powder supplying device according to claim 12, further comprising a second detection unit detecting whether the first detection unit is electrically connected to the powder supplying device, wherein the powder supplying device is controlled such that the powder supplying device does not operate when electrical connection between the first detection unit and the powder supplying device is not detected by the second detection unit.

14. The powder supplying device according to claim 1, wherein the first detection unit is controlled to detect a remaining powder in the powder container after a predetermined time has elapsed from a start of operation of the gas blowout part.

15. The powder supplying device according to claim 1, wherein the first detection unit is controlled to detect a remaining powder in the powder container when operation of the gas blowout part is detected continuously for a predetermined period of time by the first detection unit.

16. The powder supplying device according to claim 1, wherein the first detection unit is controlled to detect a remaining powder in the powder container when a condition of the gad blowout part is detected continuously for a predetermined number of times by the first detection unit.

17. The powder supplying device according to claim 1, wherein the first detection unit is inclined so that gas is ejected from the gas blowout part to a detection surface of the first detection unit.

18. The powder supplying device according to claim 1, wherein the powder contained in the powder container is a toner.

19. The powder supplying device according to claim 1, wherein the powder contained in the powder container is a two-component developer consisting of a toner and a carrier.

20. An image forming device in which a powder supplying device is provided to supply powder to a powder receiving device, the powder supplying device comprising:

a powder container containing powder therein and provided at a bottom of the powder container with a gas blowout part for ejecting gas to the inside of the powder container;

a powder transport unit attracting powder contained in the powder container from a suction opening and transporting the powder to the powder receiving device; and a first detection unit provided in the powder container to detect a remaining powder in the powder container, wherein the first detection unit includes a plurality of sensors which are disposed side by side at separate locations in a direction substantially perpendicular to a top surface of the powder container.

* * * * *